United States Patent [19]

Okamoto et al.

[11] 4,089,285

[45] May 16, 1978

[54] SECONDARY BARRIER CONSTRUCTION FOR VESSELS CARRYING SPHERICAL LOW TEMPERATURE LIQUIFIED GAS STORAGE TANKS

[75] Inventors: Tomiyasu Okamoto; Tsunanori Nishimoto; Kaoru Sawada; Koji Hayakawa; Tomomichi Kurihara, all of Osaka, Japan

[73] Assignee: Hitachi Shipbuilding & Engineering Co., Ltd., Osaka, Japan

[21] Appl. No.: 725,462

[22] Filed: Sep. 22, 1976

[51] Int. Cl.[2] ..... B63B 3/68; B63B 25/16

[52] U.S. Cl. ..... 114/74 A; 220/448

[58] Field of Search ..... 114/74 A; 220/9 LG, 220/9 F, 15

[56] References Cited

U.S. PATENT DOCUMENTS

| | | | |
|---|---|---|---|
| 3,595,424 | 7/1971 | Jackson | 114/74 A X |
| 3,895,159 | 7/1975 | Yoshimura | 220/91 LG X |
| 3,903,824 | 9/1975 | Laverman et al. | 114/74 A |
| 3,922,987 | 12/1975 | Tornay | 220/9 LG X |
| 3,927,788 | 12/1975 | Zinniger et al. | 114/74 A X |

*Primary Examiner*—Barry L. Kelmachter
*Attorney, Agent, or Firm*—Joseph W. Farley

[57] ABSTRACT

A secondary insulating barrier for protecting the hold of a ship below a spherical low temperature liquified gas storage tank installed therein comprises at least two layers of rigid foam synthetic resin sprayed on the hold plates and covered by a layer of glass mesh and adhesive. Alternatively, the layers of synthetic resin, glass mesh and adhesive are applied to plywood attached to the hold plates by joists, thus forming an air space between the secondary barrier and the hold plates. Where the hold plates have a multi-surface construction, laminated rigid urethane foam blocks are butted end-to-end and are bonded to each other and to the plywood sheets at the corners between adjacent hold plates, the spray-formed layers are applied between the blocks, and the whole is covered by a protective layer of glass mesh and adhesive.

4 Claims, 5 Drawing Figures

SECONDARY BARRIER CONSTRUCTION FOR VESSELS CARRYING SPHERICAL LOW TEMPERATURE LIQUIFIED GAS STORAGE TANKS

The present invention relates to a secondary barrier construction for low temperature liquified gas storage spherical tank carrying vessels, and more particularly it relates to a secondary barrier device to be installed on the hold bottom plate below a spherical tank in a low temperature liquified gas carrying vessel.

In a low temperature liquified gas carrying vessel, it is required to provide a secondary barrier so that if the low temperature liquified gas storage tank is broken, causing the liquified gas to leak, the leakage gas may be temporarily received in order to prevent the ship's hull temperature from becoming lower than an allowable value. In cases where such a secondary barrier is constructed of ship's hull members, which cannot endure the low temperature of the liquified gas, it is necessary to provide a heat insulating device having sufficient liquid-tightness and pressure resistance to protect the ship's hull members. However, such a secondary barrier tends to be so complicated in construction that when it is to be installed on the hold bottom which is narrow, it is desirable to reduce the ship building cost by simplifying the construction.

The main object of the present invention is to provide a secondary barrier of simple construction which can be formed very easily. Such secondary barrier construction comprises a plurality of rigid foam synthetic resin layers spray-formed directly, or indirectly through plywood, on a hold bottom plate disposed on the hold bottom carrying a low temperature liquified gas storage spherical tank, so that the formation is very easy and the working efficiency can be improved. Further, since the surface of the said rigid foam resin layers is provided with a protective layer having liquid-tightness and pressure resistance, a receiving dish can be constructed which has the heat dissipating property, liquid-tightness and pressure resistance required when the liquified gas leaks. Further, this secondary barrier is capable of preventing the entry of sea water by its protective layer in the case of minor damage to the hold bottom plate.

According to a desirable embodiment of the invention, plywood fixed on said hold bottom plate through joists is interposed between the upper surface of said hold bottom plate and said resin layer so as to define an air space between said hold bottom plate and said plywood. According to this arrangement, the heat insulating performance can be further improved and the stress in the inner shell of the hull will not be transmitted to the resin layer, so that even if the inner shell cracks, there is no possibility of the resin layer being directly influenced and caused to crack to detract from its performance as the secondary barrier.

Particularly when plywood is provided through joints, since the plywood has a suitable strength as the secondary barrier, even if water enters the air space, there is no possibility of the resin layer absorbing water to lose the heat insulating effect. Therefore, it is desirable to subject the back surface of the plywood and the surfaces of the joists to a water-proof treatment.

Further, according to a desirable embodiment of the invention, said hold bottom plate is of a concave multi-surface construction extending along the lower wall of the spherical storage tank, and at the corners of this hold bottom plate a laminated foam resin body is fixed to form a heat insulating layer while the planes excluding the corners are formed with a heat insulating layer using a plurality of spray-formed layers of rigid foam resin. According to this arrangement, since a laminated resin body is used at corners where it is difficult to form a heat insulating layer of predetermined thickness by spraying while a heat insulating layer is formed by spraying on the planes where such formation is easy, the working efficiency is improved and uniform heat insulating layers can be formed and they can be securely joined together by tilting opposite end edges of the laminated resin body.

Other numerous features and merits of the present invention will be readily understood from the following description of embodiments of the invention with reference to the accompanying drawings.

IN THE DRAWINGS

Figure 1:
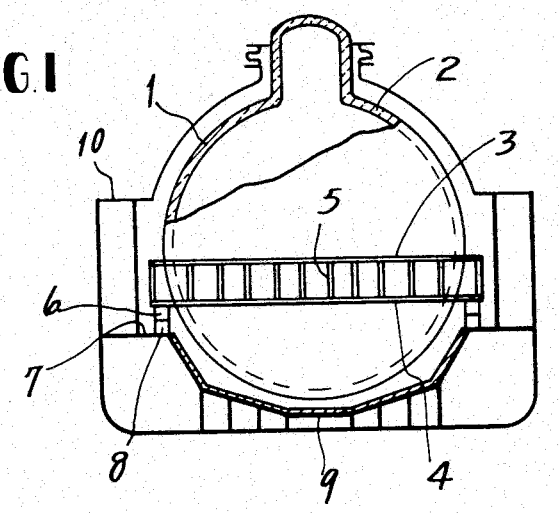
FIG. 1 is a partly broken-away cross-sectional view of a low temperature liquified gas carrying vessel having spherical tanks.

In FIG. 1, the character 1 is a tank wall; 2, a heat insulating device attached to the surface of the tank wall 1; 3 and 4, upper and lower horizontal support rings horizontally projecting from the tank wall 1 and disposed in the vincinity of the equator of the tank and in a circumferential position spaced therebelow; and 5 are stiffeners interposed between said upper and lower rings 3 and 4. Designated at 6 are support chocks circumferentially equispaced and fixed to the lower surface of the lower support ring 4, said support chocks being placed on support blocks 8 fixed on a support deck 7, with a suitable pressure-resistant heat insulating material interposed therebetween. Such support arrangement allows the radial expansion and contraction of the tank. The character 9 designates a secondary barrier and 10 designates an upper deck.

Figure 2:
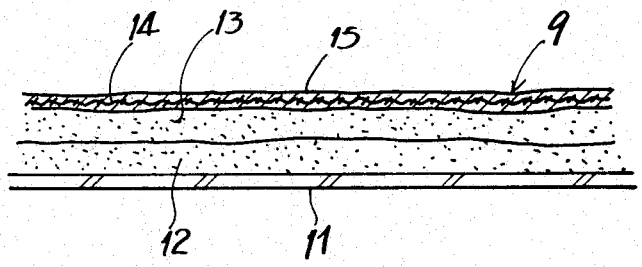
FIG. 2 is a sectional view showing a secondary barrier according to first embodiment of the invention.

FIG. 2 shows the cross-section of the secondary barrier 9, wherein 11 designates a hold bottom plate; 12 and 13, two layers, upper and lower, of a rigid foam synthetic resin such as rigid urethane foam spray-formed on said hold bottom plate 11; and 14 designates glass mesh bonded to the upper surface of the upper rigid foam synthetic resin layer 13 by an adhesive agent and having a protective layer 15 formed on the surface thereof by applying said adhesive agent several times.

The order of construction will now be described.

Two rigid foam synthetic resin layers 12 and 13 are formed directly on the hold bottom plate 11 by spraying and large undulations on the upper surface of said layer 13 are scraped and a bonding agent is applied to the scraped surface for surface treatment. Subsequently, while an adhesive agent is being applied to the upper surface of said upper rigid foam synthetic resin layer glass mesh 14 is applied thereto, and then such adhesive agent is applied to the surface of the glass mesh 14 several times to form a protective layer 15.

In addition, after a bonding agent is applied to the surface of the hold bottom plate 11, a rigid foam synthetic resin may by sprayed or spraying may be effected with a shift-preventive member provided on the surface of the hold bottom plate 11. The number of rigid foam synthetic resin layers is not limited to two.

Figure 3:
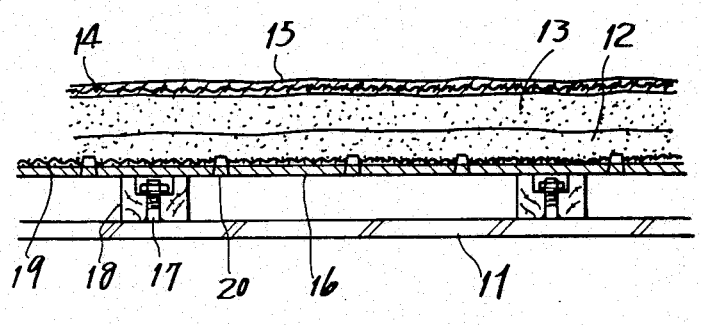
FIG. 3 is a sectional view showing a second embodiment.

A second embodiment will now be described with reference to FIG. 3. The same parts as those shown in FIG. 2 are given the same reference numerals.

Designated at 16 is a plywood sheet supporting the heat insulating layer section and fixed by screws, nails or the like on joists 18 fixed to joist fixing bolts 17 welded or otherwise secured to the hold bottom plate 11. The back surface of said plywood sheet 16 and the surfaces of said joists 18 are treated with paint for water-proofing, and an air is defined between said plywood sheet 16 and hold bottom plate 11. Designated at 19 is a hexagon-mesh wire net fixed by the use of staples 20 to the front surface of the plywood sheet 16 which is coated with a bonding agent. Designated at 12 and 13 are rigid foam synthetic resin layers similar to those described above, which are spary-formed on said plywood sheet 16 and hexagon-mesh wire net 19 and on which a protective layer 15 consisting of glass mesh 14 and an adhesive agent is formed.

The order of construction will now be described.

Marking for positioning the joists fixing bolts is made on the hold bottom plate 11, and the joist fixing bolts 17 are then fixed in position as by welding. The joists 18 are fixed in position by said bolts 17 and subjected to water-proof treatment using paint. Subsequently, the plywood sheet 16 having its back surface subjected to water-proof treatment using paint is fixed to said joists 18 by screws, nails or the like and a bonding agent is applied to the front surface of the plywood sheet 16. The hexagon-mesh wire net 19 is then fixed on the front surface of the plywood sheet 16 by staples 20 driven at suitable intervals, and a rigid foam synthetic resin is sprayed thereover to form two layers 12 and 13, upper and lower, as described above, on top of which a protective layer 15 is formed.

A third embodiment of the invention, featured by the construction of a heat insulating layer at the corners of the hold bottom plate, will now be described with reference to FIGS. 4 and 5. The same parts as those shown in FIGS. 2 and 3 are given the same reference numerals and a description thereof is omitted.

Figure 4:
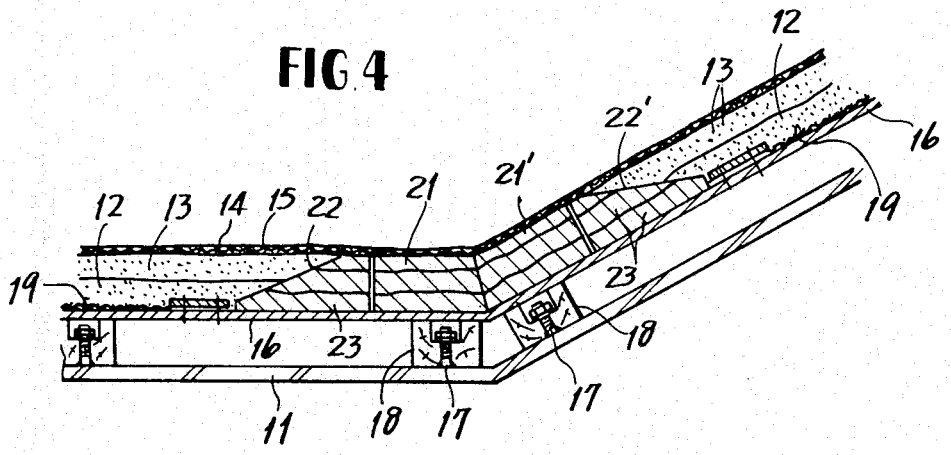
FIGS. 4 and 5 show a third embodiment having features at corners, FIG. 4 being a sectional view and FIG. 5 being a perspective view showing the steps of formation.
Figure 5:
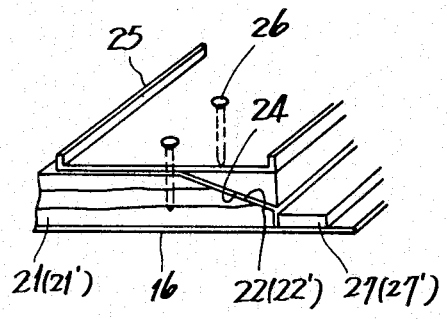

In FIG. 4, designated at 21 and 21′ are laminated bodies of a rigid foam resin such as rigid urethane foam bonded end-to-end to form a butt joint at a corner of the plywood sheet 16 with their opposite end edges to the butt joint being shaped to provide inclined surfaces 22 and 22′ having a gradually decreasing thickness, said bodies being bonded to the upper surface of the plywood sheet 16 in the vicinity of the corner. The laminated rigid foam resin bodies 21 and 21′ are each constituted by a plurality of unit rigid foam sheets 23 bonded together. Designated at 12 and 13 are two layers, upper and lower, of a rigid foam resin such as rigid urethane foam spray-formed on the plywood sheet 16 through the hexagon-mesh wire net 19, the uppermost surface being sprayed so as to be substantially flush with the upper surface of the laminated rigid foam resin bodies 21 and 21′, the sprayed layers extending upwardly along the inclined surfaces 22 and 22′ of said laminated rigid foam resin bodies 21 and 21′ and joined to said inclined surfaces 22 and 22′.

The order of construction will now be described.

After the plywood sheets 16 are attached to the hold bottom plate 11 in the same manner as that described above, the laminated bodies 21 and 21′ of a rigid foam resin such as rigid urethane foam are formed at a corner of the hold bottom plate 11 in such a manner that pluralities of rigid foam resin sheets 23 are first laminated on the plywood sheets 16 in the vicinity of the corner in end-to-end relation at the corner with the opposite end edges shaped to provide inclined surfaces 22 and 22′ and with an adhesive agent applied to the butt joint and between the resin sheets 23 and to the abutment against the plywood sheets 16. As shown in FIG. 5, a reinforcing plate 25 having an inclined portion 24 corresponding to said inclined surfaces 22 and 22′ is placed to abut against the surfaces of the laminated rigid foam resin bodies 21 and 21′ and is temporarily fixed to the plywood sheet 16 by nails 26, while positioning plywood sheets 27 and 27′ are fixed to the plywood sheets 16 at the front of the inclined surfaces 22 and 22′ to prevent the shift of the laminated rigid foam resin bodies 21 and 21′, thereby forming the laminated rigid foam resin bodies 21 and 21′. Thereafter, the reinforcing plate 25 and nails 26 are removed and an adhesive agent is poured into the nail holes to fill the latter. A bonding agent is then applied to the inclined surfaces 22 and 22′.

A bonding agent is applied to the surfaces of the plywood sheets 16 except where the laminated rigid foam resin bodies 21 and 21′ are bonded thereto, and the hexagon-mesh wire net 19 is fixed thereon by using staples at suitable intervals. A rigid foam resin such as rigid urethane foam is then sprayed thereover to form two layers 12 and 13, upper and lower, and large undulations are scraped to level the surface and a bonding agent is applied to the scraped surface for surface treatment. In this connection, the sprayed layers extend along the inclined surfaces 22 and 22′ of the laminated rigid foam resin bodies 21 and 21′ and enter the upper area thereof and are bonded to said inclined surfaces 22 and 22′, the uppermost surface thereof being substantially flush with the upper surface of the laminated rigid foam resin bodies 21 and 21′. Next, a bonding agent is applied to the upper surfaces of the upper rigid foam resin layers 13 and to the upper surfaces of the laminated rigid foam resin bodies 21 and 21′ while bonding the glass mesh 14, and an adhesive agent is applied to the surface of the glass mesh 14 several times to form the protective layer 15.

We claim:

1. A secondary barrier construction for the hold plate of a vessel carrying a spherical low temperature liquified gas storage tank, comprising joists mounted on said hold plate;

a plywood sheet having a back surface and a front surface;

means fixing said plywood sheet to said joists whereby an air space is defined between said back surface and the hold plate;

a wire net fixed to said front surface of said plywood sheet;

a plurality of rigid foam synthetic resin layers spray-formed on said front surface of said plywood sheet and a protective layer formed on the surface of said resin layers.

2. A secondary barrier construction as set forth in claim 1, wherein said hold plate comprises a concave multi-surface construction extending adjacent to the lower outer wall of the spherical storage tank and defining a plurality of corner areas, and further comprising a plurality of laminated rigid foam bodies, means for fixing said laminated rigid foam bodies to said plywood sheet at said corner areas, said plurality of rigid foam synthetic resin layers extending between said laminated resin bodies, and said protective layer being formed on the surfaces of said resin layers and laminated resin bodies.

3. A secondary barrier construction as set forth in claim 2, wherein said laminated resin bodies are bonded in end-to-end relation in the corner areas.

4. A secondary barrier construction as set forth in claim 2, wherein the opposite end edges of said laminated resin bodies are shaped to provide inclined surfaces having a gradually decreasing thickness.

* * * * *

UNITED STATES PATENT AND TRADEMARK OFFICE

CERTIFICATE OF CORRECTION

PATENT NO. : 4,089,285

DATED : May 16, 1978

INVENTOR(S) : Tomiyasu Okamoto; Tsunanori Nishimoto; Kaoru Sawada; Koji Hayakawa; Tomomichi Kurihara It is certified that error appears in the above-identified patent and that said Letters Patent are hereby corrected as shown below:

Column 2, line 34, change "vincinity" to read --vicinity--;

Column 2, line 62, after the word "layer" insert --13--;

Column 3, line 13, after the word "air" insert --space--;

Column 3, line 19, change "spary" to read --spray--.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*